US005845797A

United States Patent [19]

Sudo et al.

[11] Patent Number: 5,845,797

[45] Date of Patent: Dec. 8, 1998

[54] RUBBER PLUG FOR DRUG VESSEL

[75] Inventors: Morihiro Sudo; Masaru Shirai; Kohichi Asai, all of Tokyo, Japan

[73] Assignee: Daikyo Seiko, Ltd., Tokyo, Japan

[21] Appl. No.: 801,114

[22] Filed: Feb. 14, 1997

[30] Foreign Application Priority Data

Jul. 31, 1996 [JP] Japan ..... 8-216908

[51] Int. Cl.[6] ..... B65D 51/16

[52] U.S. Cl. ..... 215/247; 215/355

[58] Field of Search ..... 215/247, 355, 215/364, 307; 277/207 R, 207 A, 208; 604/415

[56] References Cited

U.S. PATENT DOCUMENTS

| | | | |
|---|---|---|---|
| 2,649,090 | 8/1953 | Parsons et al. . | |
| 3,849,072 | 11/1974 | Ayres | 215/355 X |
| 4,226,334 | 10/1980 | Weiler et al. | 215/355 |
| 4,488,656 | 12/1984 | Fukuoka et al. | 215/307 |
| 4,872,572 | 10/1989 | Schrooten | 215/247 X |
| 4,915,243 | 4/1990 | Tatsumi et al. | 215/247 |
| 5,171,214 | 12/1992 | Kolber et al. | 215/355 X |
| 5,171,304 | 12/1992 | Ris et al. | 215/355 X |
| 5,297,561 | 3/1994 | Hulon | 215/355 X |

FOREIGN PATENT DOCUMENTS

| | | | |
|---|---|---|---|
| 1255197 | 1/1961 | France | 215/307 |
| 2501636 | 9/1982 | France | 215/355 |
| 886821 | 1/1962 | United Kingdom | 215/355 |

*Primary Examiner*—Allan N. Shoap
*Assistant Examiner*—Nathan Newhouse
*Attorney, Agent, or Firm*—Oblon, Spivak, McClelland, Maier & Neustadt, P.C.

[57] ABSTRACT

A rubber plug for a drug vessel has at least one convexity formed on a surface of the rubber plug so that the rubber plug is prevented from sticking together, joining together under compression or joining together under suction with another rubber plug of a similar type. The convexity may preferably be a grain pattern formed on at least a part of the surface of the rubber plug by transferring same from a mold. A rubber plug for a drug vessel may also be composed of a leg portion and a head portion formed integrally with the leg portion and may have at least one convexity on at least one of the leg portion and the head portion.

15 Claims, 5 Drawing Sheets

RUBBER PLUG FOR DRUG VESSEL

BACKGROUND OF THE INVENTION a) Field of the Invention

This invention relates to a vial plug for use with a vial for a drug or the like, and especially to a rubber plug for a drug vessel, said rubber plug being suited as a plug for use with a vial which is employed to be filled with a powder preparation, lyophilized preparation or liquid preparation.

b) Description of the Related Art

Rubber plugs made of butyl rubber or the like have conventionally been used as rubber plugs for drug vessels. From the standpoint of safety and sanitation, rubber plugs for drug vessels are always subjected to washing, sterilization and drying before their use.

Such a rubber plug for a drug vessel is generally composed of a head portion 1 and a leg portion 2, as shown in FIG. 6 which is a perspective view of a typical example.

One problem which arises upon washing, sterilization and drying of these rubber plugs is the sticking together, joining together under compression and joining together under suction of these rubber plugs. In rubber plugs for drug vessels, sticking together tends to occur especially between leg portions themselves, between a leg portion and a head portion, and also between an upper wall of a head portion and a lower wall of another head portion. On the other hand, joining together under compression and joining together under suction are prone to occur between a free end of a leg portion and a free end portion of another leg portion and also between a leg portion and a head portion.

Such sticking together, joining together under compression and joining together under suction of rubber plugs for drug vessels take place in any one of the above-described treatments, leading to insufficient washing, sterilization or drying at portions stuck together, portions joined together under compression and portions joined together under suction of the rubber plugs. The insufficient drying allows water to remain there. Therefore these insufficient washing, sterilization and drying become problems for the safety and sanitation of drugs stored inside the vessels.

These rubber plugs are accompanied by other problems. The rubber plugs stick together into blocks when they are transferred to the next step subsequent to the above treatments. Prior to fitting them in vials or the like, the stuck rubber plugs must be separated from each other. This requires extra labor. Water often remains at contacted portions of rubber plugs which have been joined together under compression or suction. Further, upon separation of these joined rubber plugs from each other at the portions joined together under compression or suction, rubber chips are formed. These rubber chips then contaminate other rubber plugs. It has therefore been desired to prevent sticking together, joining together under compression and joining together under suction of rubber plugs upon conducting the washing, sterilization and drying of the rubber plugs.

With a view to preventing the above-described sticking together, joining together under compression or joining together under suction of rubber plugs for drug vessels and also imparting chemical resistance, solvent resistance, ozone resistance and the like to the rubber plugs, it is practiced to coat the rubber plugs with a fluorinated resin, silicone resin or the like. This method is however not effective at all for the prevention of joining together under compression or joining together under suction of the rubber plugs and moreover, the above-described coating materials are expensive and the forming step of coatings is irksome. This method is however not considered to be suited for general-purpose rubber plugs for drug vessels.

As other methods, it has also been proposed, for example, to apply a satin pattern to a surface of a rubber plug upon molding by using a mold whose surface has been sandblasted or to sprinkle fine powder of a crosslinked resin over a surface of an unvulcanized rubber stock and then to mold the rubber stock into a rubber plug for a drug vessel. These methods however also involve one or more problems. The former method cannot bring about any substantial effect for the prevention of sticking together, joining together under compression or joining together under suction of rubber plugs, while latter method can hardly sprinkle the fine powder of the crosslinked resin evenly over the surface of the rubber stock and the fine powder of the crosslinked resin tends to fall off from the surface of the rubber plug for the drug vessel. It is therefore the current situation that no effective method has been found yet for the prevention of sticking together, joining together under compression or joining together under suction of rubber plugs for drug vessels.

SUMMARY OF THE INVENTION

The present invention has been completed with the foregoing circumstances in view. An object of the present invention is therefore to provide a rubber plug for a drug vessel (hereinafter simply called the "rubber plug") which does not develop the above-described problems, that is, which is prevented from sticking together, joining together under compression or joining together under suction when subjected to washing, sterilization or drying.

The above object has been achieved by the present invention. In one aspect of the present invention, there is thus provided a rubber plug for a drug vessel, comprising at least one convexity formed on a surface of said rubber plug so that said rubber plug is prevented from sticking together, joining together under compression or joining together under suction with another rubber plug of a similar type. In another aspect of the present invention, there is also provided a rubber plug for a drug vessel, which comprises a grain pattern formed on at least a part of a surface of said rubber plug by transferring same from a mold. In a further aspect of the present invention, there is also provided a rubber plug for a drug vessel, said rubber plug being composed of a leg portion and a head portion formed integrally with said leg portion, which comprises at least one convexity on at least one of said leg portion and said head portion.

According to the present invention, rubber plugs prevented from sticking together, joining together under compression or joining together under suction in their washing, sterilization or drying treatment are provided.

Use of the rubber plugs according to the present invention can prevent sticking together, joining together under compression or joining together under suction thereof during each of the above-mentioned treatment steps and a conveying step, thereby making it possible to substantially improve the productivity including a step in which drug vessels such as vials are sealed by the rubber plugs.

BRIEF DESCRIPTION OF THE DRAWING

The above and other objects, features and advantages of the present invention will become apparent from the following description and the appended claims, taken in conjunction with the accompanying drawings in which:

DETAILED DESCRIPTION OF THE INVENTION AND PREFERRED EMBODIMENTS

It has heretofore been generally practiced to apply a grain pattern to a surface of a molded or otherwise formed resin or rubber product so that the molded or otherwise formed resin or rubber product can be improved in artistry or, where the molded or otherwise formed resin or rubber product is a functional part or component such as a paper sheet feed roll employed in an office automation equipment, the performance of the functional part or component can be enhanced.

As has been described above, rubber plugs which are each applied with a satin pattern on a surface thereof by molding same with a sand-blasted mold, however, cannot exhibit any substantial effect for the prevention of sticking together, joining together under compression or joining together under suction of the rubber plugs as mentioned above in the background of the invention. The present inventors were however interested in a grain pattern applied to a molded or otherwise formed rubber product by transferring same from a surface of a mold for the rubber product, and have proceed with an investigation.

As a result, it has been found that the above-described application method of a grain pattern is not effective for the prevention of sticking together, joining together under compression or joining together under suction of rather heavy, molded or otherwise formed, ordinary vulcanized rubber products but in the case of rubber plugs having a smaller shape (generally, about 6 to 31 mm or so in the diameter of a top portion and about 1.5–11 mm in the length of a leg portion), has unexpected excellent effects for the prevention of sticking together, joining together under compression or joining together under suction of the rubber plugs upon conducting washing, sterilization or drying of these rubber plugs, leading to the completion of the present invention.

Figure 1:
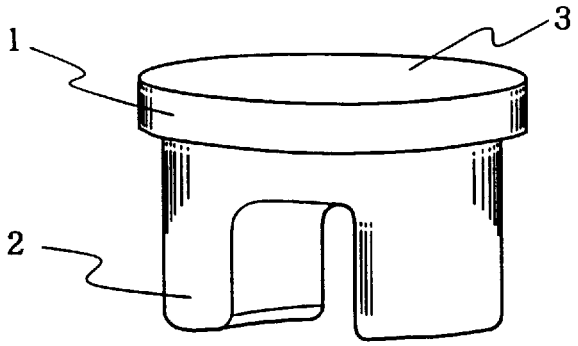
FIG. 1 is a perspective view showing one example of a rubber plug.

The present invention can be applied to all rubber plugs known to date, but is suited particularly to rubber plugs which are each composed of a head portion and a leg portion as shown in FIG. 1.

A description will hereinafter be made taking the rubber plug, which is composed of a head portion and a leg portion as shown in FIG. 1, by way of example. It is however to be noted that advantageous effects of the present invention can also be brought about similarly when the present invention is applied to rubber plugs of other shapes.

Incidentally, the expression "grain pattern (formed or applied) by transferring same from (a surface) of a mold" as used herein means that a rubber plug is molded by using a mold having a grain pattern carved on a surface thereof and the grain pattern of the mold is hence transferred onto a surface of the rubber plug.

The grain pattern, which is applied to at least a part of the surface of the rubber plug in the present invention by transferring same from the mold, is a grain pattern in the form of asperities formed on the surface of the rubber plug, because the dimensions and weight of the rubber plug are small and light. For example, the height from a predetermined surface on which the grain pattern is applied to the top of the tallest asperity varies depending on the dimensions and weight of the rubber plug and is generally 0.1 mm or less, preferably from 10 to 50 $\mu$m. It is desired to arrange a grain pattern while optimally determining the height of its asperities depending on the dimensions and weight of the rubber plug so that sticking together, joining together under compression or joining together under suction will not take place.

In view of the effect for the prevention of sticking together, joining together under compression or joining together under suction of the rubber plugs and the fabrication of a mold for the molding of the rubber plugs, it is preferred to apply a grain pattern evenly to the surface of each rubber plug. Unless the effect for the prevention of sticking together, joining together under compression or joining together under suction of the rubber plugs is impaired, the grain pattern can be applied locally in the form of spots, blocks or the like at several locations on the surface of each rubber plug or can be applied locally in a desired shape, for example, in a stripe shape such as a ring or band shape depending on the shape of the surface of each rubber plug.

In the present invention, it is most preferred to apply the grain pattern to the entire surface of each rubber plug. In particular, it is preferred to apply the grain pattern to the head portion and/or leg portion where sticking together, joining together under compression or joining together under suction tends to occur. The head portion can be an upper wall and/or lower wall of the head portion.

The above description was to apply the fine grain pattern to the surface of the rubber plug. It is also possible to prevent sticking together, joining together under compression or joining together under suction of rubber plugs by applying at least one convexity, which has a height greater than the height difference of the ruggedness of the grain pattern, to the surface of each rubber plug either in place of the grain pattern or in combination with the grain pattern. Although the preferred height of the convexity varies depending on the dimensions, weight and the like of the rubber plug, it is generally from 0.1 to 1.5 mm or so. It is however necessary to set the height of the convexity at an optimal value depending on the location of the convexity and the dimensions and weight of the rubber plug within a range not interfering with the sealing (and plugging) ability for a vial or the like.

A surface portion of the rubber plug, which is preferred for the arrangement of the convexity, is the top wall of the head portion and/or a free end portion of the leg portion. Especially when the leg portion of each rubber plug is cylindrical, it is preferred to arrange a convexity at a part of the free end of the leg portion or at a part of the upper wall of the top portion because this arrangement makes it possible to prevent rubber plugs from sticking together and water such as washing water from remaining in the cylindrical leg portions.

No particular limitation is imposed on the shape of the convexity arranged on the surface of the rubber plug. The convexity can be of any shape, insofar as it is suited for the shape of a surface on which the convexity is arranged. For the example, the convexity can be a spot-shaped (e.g., bulge-shaped, circular cylindrical, or prism-shaped) convexity, a band-shaped convexity (of a semicircular, oval, quadrilateral, trapezoidal or shaped cross-section), a ring-shaped convexity (of a similar cross-section), or the like. Further, the location where the convexity is arranged is not limited to the leg portion but can be on the head portion or another portion.

The number of such convexity(ies) and the dimensions (length, width and the like) and cross-sectional shape of each convexity can be determined depending on the location(s) of the convexity(ies) and the dimensions, weight and the like of the rubber plug so that the rubber plugs can be prevented from sticking together, joining together under compression or joining together under suction without any inhibition to the sealing ability. In the present invention, no particular limitation is imposed on the number of convexity(ies) and the shape and size of each convexity.

Further, the effect for the prevention of sticking together, joining together under compression or joining together under suction of the rubber plugs can be improved further by arranging the above-described grain pattern and convexity (ies) in combination.

The rubber plug according to the present invention, which has such a grain pattern and/or convexity on at least a part of its surface, can be produced from a rubber-plug-producing rubber composition by compression molding, transfer molding, injection molding or the like while using a mold whose surface is carved to form the grain pattern and/or convexity.

The present invention will next be described more specifically by the following Examples:

EXAMPLE 1

Rubber plugs of the shape shown in FIG. 1 (the diameter of a head portion 1: about 20 mm, the length of each leg portion 2: about 8 mm) were produced by compression molding from butyl rubber as a raw material rubber (the number of the produced rubber plugs: 500). Each of the rubber plugs had a grain pattern 4 of about 0.5 mm in height evenly formed on an upper wall 3 and peripheral side wall of the head portion 1 and also on an outer peripheral wall of each leg portion 2, said outer peripheral wall being to be brought into contact with a vial.

In a similar manner, 500 rubber plugs having the same shape as the above-produced rubber plugs and provided with a satin pattern were also produced using a sand-blasted mold (comparative example).

The above-described two types of rubber plugs were separately washed. The washing was conducted through the following successive steps:

(1) 500 rubber plugs were placed in an SUS(chromium steel)-made mesh basket, followed by dipping in a solution of a neutral detergent;

(2) the basket with the rubber plugs contained therein was placed in an autoclave which was filled with an aqueous solution of sodium hydroxide, and the rubber plugs were subjected to heat treatment;

(3) the rubber plugs which were still contained in the basket were subjected to heat treatment in a treatment tank which was filled with an aqueous solution of hydrochloric acid; and (4) the rubber plugs which were still contained in the basket were washed with purified water (for example, water processed through an ultrafiltration membrane).

The steps (2) and (3) were incorporated to remove pyrogens which may mix in an injectable preparation from the rubber plugs and may often cause pyrexia, chill or the like after injection. Sticking together of some of the rubber plugs took place in the step (2). After the completion of the step (4), the rubber plugs stuck together, joined together under compression or joined together under suction were counted. The number of rubber plugs stuck together, joined together under compression or joined together under suction during the washing was found to be 18 in the case of the rubber plugs according to the present invention as opposed to 40 in the case of the rubber plugs according to the comparative example.

EXAMPLE 2

Figure 2A:
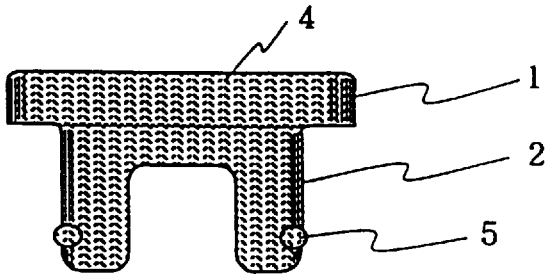
FIG. 2A is a side view of a rubber plug according to a first embodiment of the present invention, as viewed in the direction of arrow Y in FIG. 2B.
Figure 2B:
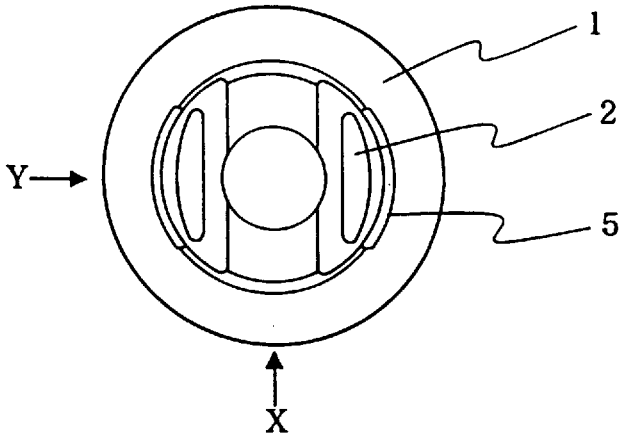
FIG. 2B is a bottom view of the rubber plug according to the first embodiment of the present invention.
Figure 2C:
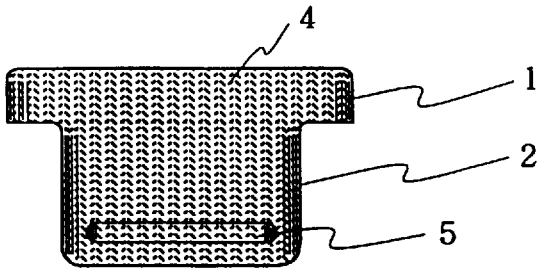
FIG. 2C is a front view of the rubber plug according to the first embodiment of the present invention, as viewed in the direction of arrow X in FIG. 2B.

Five hundred (500) rubber plugs of the same shape and size as those produced in Example 1 were produced by compression molding from the same rubber composition as that employed in Example 1. As shown in FIGS. 2A to 2C, each of the rubber plugs had a rugged grain pattern of 0.05 mm in height difference evenly applied on the entire surface thereof and also had, as convexities, ridges 5 each of which extended in an angular direction on a corresponding leg portion 2 (over about 60% of an angular length of the leg portion), had a substantially semicircular cross-section of about 0.2 mm in height and about 1 mm in width and was symmetrical with respect to an angular center of the leg portion 2.

As in Example 1, the rubber plugs were washed and the plugs stuck together, joined together under compression or joined together under suction were counted. The number of the rubber plugs stuck together, joined together under compression or joined together under suction was found to be 8.

EXAMPLE 3

Figure 3A:
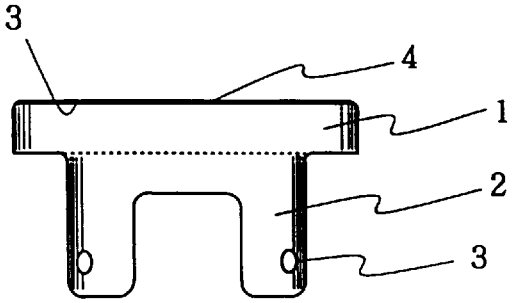
FIG. 3A is a side view of a rubber plug according to a second embodiment of the present invention, as viewed in the direction of arrow Y in FIG. 3B.
Figure 3B:
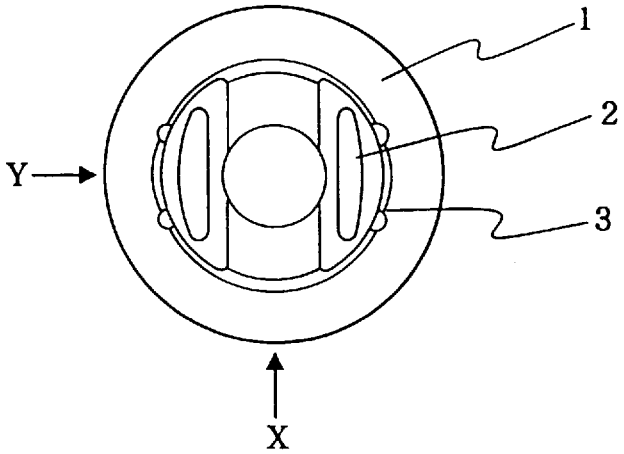
FIG. 3B is a bottom view of the rubber plug according to the second embodiment of the present invention.
Figure 3C:
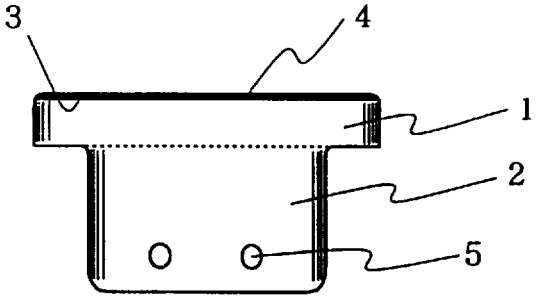
FIG. 3C is a front view of the rubber plug according to the second embodiment of the present invention, as viewed in the direction of arrow X in FIG. 3B.

Five hundred (500) rubber plugs of the same shape and size as those produced in Example 1 were produced by compression molding from the same rubber composition as that employed in Example 1. As is illustrated in FIGS. 3A to 3C, each of the rubber plugs had a rugged grain pattern of about 0.05 mm in height difference evenly applied on an entire upper surface 3 of a head portion 1 and also had, as convexities, two beads of about 2 mm in diameter and about 0.4 mm in height arranged on each of leg portions 2 at a lower part thereof (at a height of about 1.5 mm from the lower extremity) so that the two beads are located at points on the same arc while dividing the arc into three equal lengths.

As in Example 1, the rubber plugs were washed and the plugs stuck together, joined together under compression or joined together under suction were counted. The number of the rubber plugs stuck together, joined together under compression or joined together under suction was found to be 12.

EXAMPLE 4

Figure 4A:
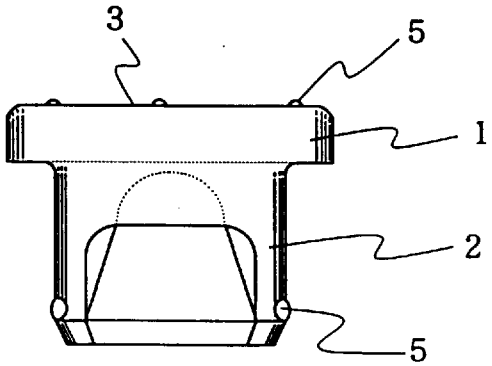
FIG. 4A is a rear view of a rubber plug according to a third embodiment of the present invention, as viewed in the direction of arrow X in FIG. 4B.
Figure 4B:
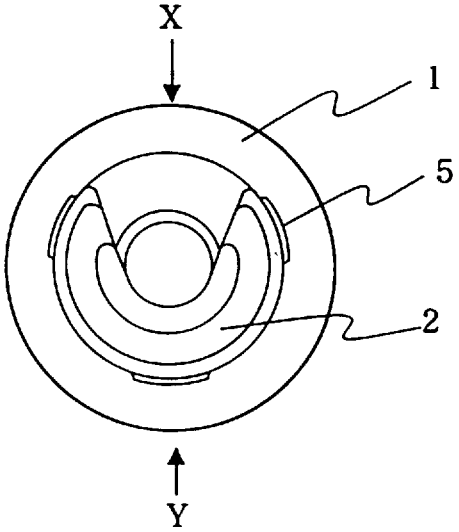
FIG. 4B is a bottom view of the rubber plug according to the third embodiment of the present invention.
Figure 4C:
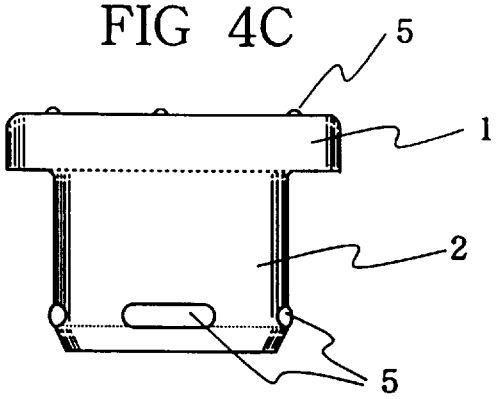
FIG. 4C is a front view of the rubber plug according to the third embodiment of the present invention, as viewed in the direction of arrow Y in FIG. 4B.

Five hundred (500) rubber plugs were produced by compression molding from the same rubber composition as that employed in Example 1. As is illustrated in FIGS. 4A to 4C, each of the rubber plugs had, as convexities, four (4) hemispherical beads 5 of about 1 mm in diameter and about 0.3 mm in height arranged at the same angular intervals on the same circle drawn about 7 mm apart from a center of an upper wall 3 of a head portion 1 (diameter: about 19 mm) and also had, as convexities, three (3) ridges arranged on the same arc at a height of about 1.5 mm from a lower extremity of a leg portion 2 (length: about 10 mm). One of the ridges is arranged at an angular center of the leg portion, while the remaining two ridges are arranged at angularly opposite end portions of the leg portion, respectively. Each ridge was about 1.5 mm in width and about 0.2 mm in height and was oval in cross-sectional shape (angular length: about 1/7 of the length of the corresponding arc). Incidentally, the leg portion 2 is in the form of a substantially cylindrical wall, which is partly cut off from a position about 3 mm the way down from a lower wall of the head portion 1 to the lower extremity of the leg portion 2 so that an opening is formed over about 90 degrees on an outer peripheral surface of the cylindrical wall and over about 140 degrees on an inner peripheral surface of the cylindrical wall, both relative to a central axis of the cylindrical wall. As a comparative example, five hundred (500) satin-patterned rubber plugs of the same shape as those obtained above except for the omission of the two types of the beads were produced.

As in Example 1, the above-produced two types of rubber plugs were separately washed, and the plugs stuck together, joined together under compression or joined together under suction were counted. The number of rubber plugs stuck together, joined together under compression or joined together under suction during the washing was found to be 10 in the case of the rubber plugs according to the present invention as opposed to 40 in the case of the rubber plugs according to the comparative example.

EXAMPLE 5

Five hundred (500) rubber plugs were produced in exactly the same manner as in Example 4 except that each rubber plug was provided on an entire surface thereof with a rugged grain pattern of about 0.05 mm in height difference. The number of rubber plugs stuck together, joined together under compression or joined together under suction was found to be 5.

EXAMPLE 6

Figure 5A:
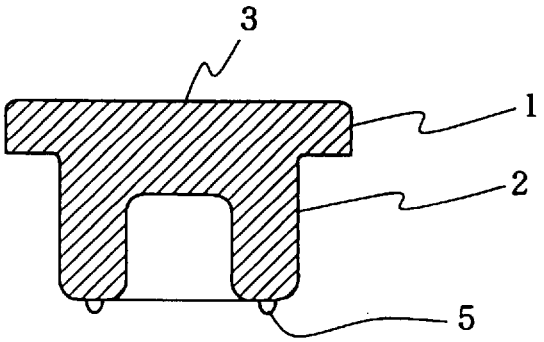
FIG. 5A is a side view of a rubber plug according to a fourth embodiment of the present invention.
Figure 5B:
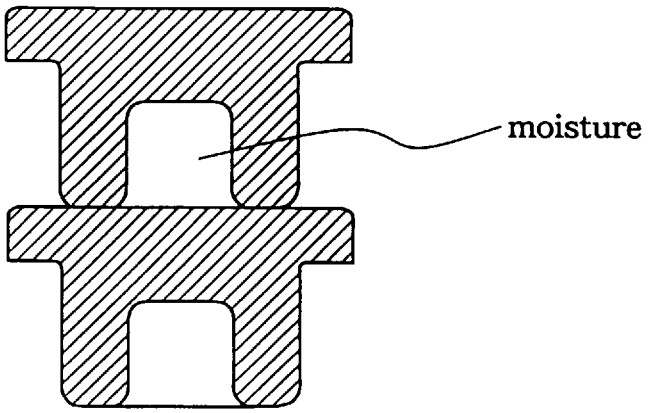
FIG. 5B is a side view of two rubber plugs, which are of the same type as the rubber plug shown in FIG. 1 and are jointed together under suction between a head portion of one of the rubber plugs and free ends of leg portions of the other rubber plug.
Figure 5C:
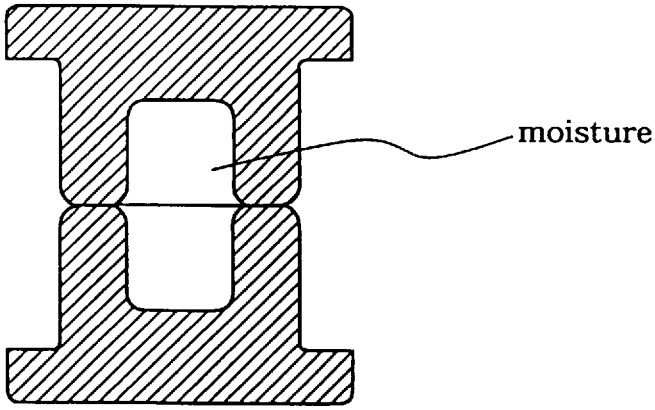
FIG. 5C is a side view of two rubber plugs, which are of the same type as the rubber plug shown in FIG. 1 and are jointed together under suction between free ends of leg portions of one of the rubber plugs and free ends of leg portions of the other rubber plug.
Figure 6:
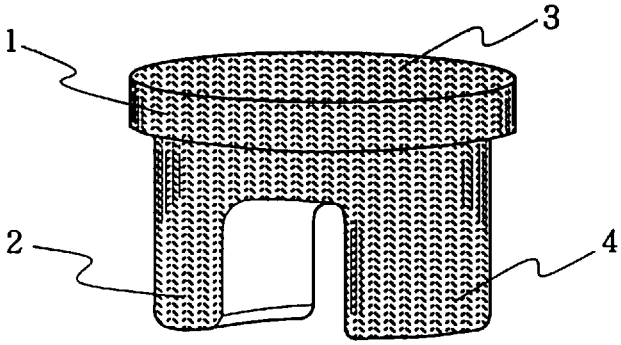
FIG. 6 is a perspective view of a rubber plug according to a conventional technique.

Five hundred (500) rubber plugs were produced as in Example 1. As is depicted in FIG. 5A, each rubber plug was similar to the rubber plug shown in FIG. 1 except for the arrangement of a bead 5 as a convexity at a free end of each leg portion 2. This bead was a hemispherical bead of about 1 mm in diameter and about 0.3 mm in height. As in Example 1, the rubber plugs were washed and the plugs stuck together, joined together under compression or joined together under suction were counted. The number of rubber plugs stuck together, joined together under compression or joined together under suction during the washing was found to be 10 in the case of the rubber plugs according to the present invention. In the case of rubber plugs provided with neither convexities nor a grain pattern, on the other hand, they developed a problem that, as is shown in FIG. 5B or 5C, the rubber plugs tended to join together under suction and water such as washing water tended to remain inside their cylindrical leg portions.

What is claimed is:

1. A rubber plug for a drug vessel, comprising a grain pattern formed on at least a part of a surface of said rubber plug by transferring same from a mold, said rubber plug including a head portion having an upper wall including an axially upwardly facing surface, said axially upwardly facing surface including said grain pattern so that said rubber plug is prevented from sticking together, joining together under compression or joining together under suction with another rubber plug of a similar type.

2. The rubber plug according to claim 1, wherein said rubber plug further comprises a leg portion formed integrally with said head portion; and said at least a part of said surface is a surface of at least one of said head portion and said leg portion.

3. The rubber plug according to claim 2, wherein said head portion has a diameter of from 6 to 31 mm and said leg portion has a length of from 1.5 to 15 mm.

4. The rubber plug according to claim 1, wherein said grain pattern is formed on an entire surface of said rubber plug.

5. The rubber plug according to claim 1, wherein said grain pattern is a grain pattern in the form of asperities.

6. The rubber plug according to claim 1, wherein said rubber plug has a weight of from 0.05 to 8 g.

7. The rubber plug according to claim 1, wherein said grain pattern has ruggedness having a height difference of from 10 to 50 $\mu$m.

8. A rubber plug for a drug vessel, said rubber plug being composed of a leg portion and a head portion formed integrally with said leg portion, comprising at least one convexity on said leg portion and at least one convexity on an upper wall of said head portion, said upper wall including an axially upwardly facing surface having a grain pattern so that said rubber plug is prevented from sticking together, joining together under compression or joining together under suction with another rubber plug of similar type.

9. The rubber plug according to claim 8, wherein said convexity has a height of from 0.1 to 1.5 mm.

10. The rubber plug according to claim 8, wherein said at least one convexity is formed on a free end of said leg portion.

11. The rubber plug according to claim 8, wherein said convexity is a convexity in the form of a band or a spot.

12. The rubber plug according to claim 8, further comprising a grain pattern formed by transferring same from a mold.

13. The rubber plug according to 12, wherein said grain pattern has ruggedness having a height difference of from 10 to 50 $\mu$m.

14. The rubber plug according to claim 8, wherein said rubber plug has a weight of from 0.05 to 8 g.

15. The rubber plug according to claim 8, wherein said head portion has a diameter of from 6 to 31 mm and said leg portion has a length of from 1.5 to 15 mm.

* * * * *